US008615957B1

(12) United States Patent
Sacks et al.

(10) Patent No.: US 8,615,957 B1
(45) Date of Patent: Dec. 31, 2013

(54) LIGHT-WEIGHT METAL STUD AND METHOD OF MANUFACTURE

(71) Applicant: Sacks Industrial Corporation, Vancouver (CA)

(72) Inventors: Abraham Sacks, Vancouver (CA); William Spilchen, White Rock (CA); Jeffrey Sacks, Vancouver (CA)

(73) Assignee: Sacks Industrial Corporation, Vancouver (CA)

( * ) Notice: Subject to any disclaimer, the term of this patent is extended or adjusted under 35 U.S.C. 154(b) by 0 days.

(21) Appl. No.: 13/767,764

(22) Filed: Feb. 14, 2013

(51) Int. Cl.
*E04B 5/10* (2006.01)
*E04H 12/00* (2006.01)
*E04C 3/00* (2006.01)

(52) U.S. Cl.
USPC ..... 52/647; 52/654.1; 52/660; 52/846

(58) Field of Classification Search
USPC ..... 52/633, 638, 647, 648.1, 650.1, 653.1, 52/654.1, 655.1, 660, 836, 840, 846, 636, 52/637, 639
See application file for complete search history.

(56) References Cited

U.S. PATENT DOCUMENTS

| | | | | | |
|---|---|---|---|---|---|
| 1,986,171 | A * | 1/1935 | Wilson | 52/336 |
| 2,136,071 | A * | 11/1938 | Braden | 52/694 |
| 2,996,160 | A * | 8/1961 | Voight | 52/376 |
| 4,485,606 | A * | 12/1984 | Gottlieb | 52/694 |
| 4,669,243 | A * | 6/1987 | Gore et al. | 52/696 |
| 5,852,908 | A * | 12/1998 | Nankin | 52/838 |
| 5,867,962 | A * | 2/1999 | Scott et al. | 52/696 |
| 7,735,294 | B2 * | 6/2010 | Moody et al. | 52/745.19 |
| 2010/0126097 | A1 * | 5/2010 | Powers, III | 52/481.1 |
| 2010/0287872 | A1 * | 11/2010 | Bodnar | 52/582.1 |

* cited by examiner

*Primary Examiner* — Jessica Laux
(74) *Attorney, Agent, or Firm* — Seed IP Law Group PLLC

(57) ABSTRACT

A light-weight metal stud and method to produce a light-weight metal stud may include forming a pair of channel members each having a respective major face having a respective first edge. Each member includes first and second flanges extending along the respective major face. A wire matrix includes a pair of wires each having apexes alternatively physically attached to the pair of channel members. The wire matrix forms longitudinal passages to support utility lines and position the lines away from the pair of channel members. The apexes are secured to flanges of the pair of channel members to strengthen the stud and reduce weight.

17 Claims, 6 Drawing Sheets

LIGHT-WEIGHT METAL STUD AND METHOD OF MANUFACTURE

BACKGROUND

1. Technical Field

The present disclosure relates to structural members, and more particularly, to metal studs.

2. Description of the Related Art

Metal studs and framing members have been used in the areas of commercial and residential construction for many years. Metal studs offer a number of advantages over traditional building materials, such as wood. For instance, metal studs can be manufactured to have strict dimensional tolerances, which increase consistency and accuracy during construction of a structure. Moreover, metal studs provide dramatically improved design flexibility due to the variety of available sizes and thicknesses and variations of metal materials that can be used. Moreover, metal studs have inherent strength-to-weight ratio which allows them to span longer distances and better resist forces such as bending moments.

Although metal studs exhibit these and numerous other qualities, there are some challenges associated with their manufacture and use in construction. For instance, existing designs typically sacrifice strength over weight of the stud. Conventional metal studs are often formed from one piece of metal and weigh about 0.77 pounds per foot, or 6.2 pounds per eight foot stud having dimensions of 3⅝ inch deep by 1¼ inch flange of 22 gauge.

Furthermore, manufacturing efficiency considerations can play a large role in the design of a metal stud because additional manufacturing operations can quickly increase the cost of each stud, which results in an unmarketable metal stud. Thus, the uniform design of existing metal studs often employ more material than is necessary for a given strength.

BRIEF SUMMARY

A light-weight metal stud may include a first elongated channel member having a respective major face having a respective first edge along a major length thereof. The first elongated channel member may include a respective second edge along the major length thereof and a respective first flange extending along the first edge at a non-zero angle to the respective major face of the first elongated channel member. The first elongated channel member may include a respective second flange extending along the second edge at a non-zero angle to the respective major face of the first elongated channel member.

The stud may include a second elongated channel member having a respective major face having a respective first edge along a major length thereof. The second elongated channel member may include a respective second edge along the major length thereof and a respective first flange extending along the first edge at a non-zero angle to the respective major face of the second elongated channel member. The second elongated channel member may include a respective second flange extending along the second edge at a non-zero angle to the respective major face of the second elongated channel member.

The stud may include a first continuous wire member (or metal coupler member) having a plurality of bends to form alternating apexes along a respective length thereof. The apexes of the first continuous wire member may be alternatively physically attached to the first and the second elongated channel members along at least a portion of the first and the second elongated channel members. The stud may include a second continuous wire member (metal coupler member) having a plurality of bends to form alternating apexes along a respective length thereof. The apexes of the second continuous wire member may be alternatively physically attached to the first and the second elongated channel members along at least a portion of the first and the second elongated channel members. The first and the second elongated channel members may be held in spaced apart parallel relation to one another by both of the first and the second wire members. A longitudinal passage may be formed between the first and the second wire members.

In some aspects, the first and the second wire members are physically attached to one another at each point at which the first and the second wire members cross one another. This may form a wire matrix having a plurality of intersection points. Each of the apexes of the second wire member is opposed to a respective one of the apexes of the first wire member across the longitudinal passage. In some aspects, the respective second flange of at least one of the first or the second elongated channel member is a non-right angle. In some aspects, the respective second flange of at least one of the first or the second elongated channel member is a rolled edge. In some aspects, the respective second flange of each of the first and the second elongated channel member is has an arcuate profile.

The first flange of at least one of the first or the second elongated channel member may be corrugated, which may include a number of ridges or valleys extending along the major length of the first edge. The first and the second continuous wires may be physically attached to the ridges or the valleys of the respective first flange of at least one of the first and the second elongated channel member via welds. In some aspects, the first and the second continuous wires do not physically contact the respective major faces of at least one of the first or the second elongated channel member.

In some aspects, a first longitudinal wire member extends along the major length of the first channel member and is spaced inwardly from the first channel member toward the second channel member. A second longitudinal wire member may also extend along the major length of the second channel member and spaced inwardly from the second channel member toward the first channel member, and spaced apart from the first longitudinal wire member.

Because of the configurations discussed in the present disclosure, the stud has improved compression and tension resistance as compared to existing studs. Moreover, the distance (pitch) between each apex along the stud is dramatically decreased due to the angle of the bends of the wires and the configuration of providing two wires alternately extending between the channel members. This provides further strength without increasing the weight of the stud. Another advantage of the present disclosure is an increase in stiffness due to the position and attachment of the plurality of apexes to the flanges of the channel members. This is particularly advantageous when applying a force to the first and second channel members, such as when drilling a fastener through the members for attachment to a wall or attachment of a utility device or line. The increased stiffness may provide resistance characteristics such that the stud will not buckle or flex under a given load or force, for example.

Furthermore, securing the apexes to the flanges of the channel members (as opposed to the major faces) provides one advantage to reduce manufacturing operations and improve consistency of the size and shape of the stud because the channel members can be positioned relative to each other, as opposed to relative to the shape and size of the wire matrix defined by the apexes, which may vary between manufacturing operations of each stud. Spatially positioning the wire matrix away from the major faces further provides improved strength without increasing weight of the stud because a transfer of forces between the channel members is reduced because the wire matrix is coupled to the flanges, not directly to the major faces. Accordingly, a stiffer and lighter metal stud is provided while minimizing manufacturing operations and material use per stud, as compared to existing metal studs.

Because of the configuration of some or all of the various aspects discussed in the present disclosure, the metal stud is stronger and lighter than conventional metal studs. In its basic form, the metal stud of the present disclosure with similar dimensions and strength as the 3⅝ inch stud discussed in the background section can weigh about 0.58 pounds per foot, or 4.67 pounds per eight foot stud, although this weight may vary depending on the cross sectional size of the stud. Thus, the metal stud is at least 25 percent lighter than conventional metal studs, and stronger for the reasons discussed in the present disclosure. This has one advantage of reduced manufacturing and shipping costs, and another advantage of reduced overall weight of a structure that may have a plurality of metal studs forming walls and trusses.

A method of making a metal stud may include providing a first elongated channel member having a respective major face having a respective first edge along a major length thereof. The first elongated channel member may be formed to have a respective second edge along the major length thereof and a respective first flange extending along the first edge at a non-zero angle to the respective major face of the first elongated channel member. The first elongated channel member may be formed to have a respective second flange extending along the second edge at a non-zero angle to the respective major face of the first elongated channel member.

The method may include providing a second elongated channel member having a respective major face having a respective first edge along a major length thereof and a respective second edge along the major length thereof. The second elongated channel member may be formed to have a respective first flange extending along the first edge at a non-zero angle to the respective major face of the second elongated channel member, and a respective second flange extending along the second edge at a non-zero angle to the respective major face of the second elongated channel member.

The method may include coupling the first and the second elongated channel member together with a first and a second continuous wire member. The first and second continuous wire members may be formed with a plurality of bends to form alternating apexes along a respective length thereof. The apexes of the first continuous wire member may be alternatively physically attached to the first and the second elongated channel members along at least a portion of the first and the second elongated channel members. The apexes of the second continuous wire member may be alternatively physically attached to the first and the second elongated channel members along at least a portion of the first and the second elongated channel members.

The method may include physically attaching the first and the second continuous wire members to one another at intersection points, which may occur before the coupling the first and the second elongated channel member together via the first and the second continuous wire members. The method may include rolling the respective second edge of the first and the second channel members to form the non-right angle flange.

BRIEF DESCRIPTION OF THE SEVERAL VIEWS OF THE DRAWINGS

In the drawings, identical reference numbers identify similar elements or acts. For clarity of illustration, similar elements within a figure may only be called out for a representative element of similar elements. Of course, any number of similar elements may be included in a metal stud, and the number of similar elements shown in a drawing is intended to be illustrative, not limiting. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION

Figure 1A:
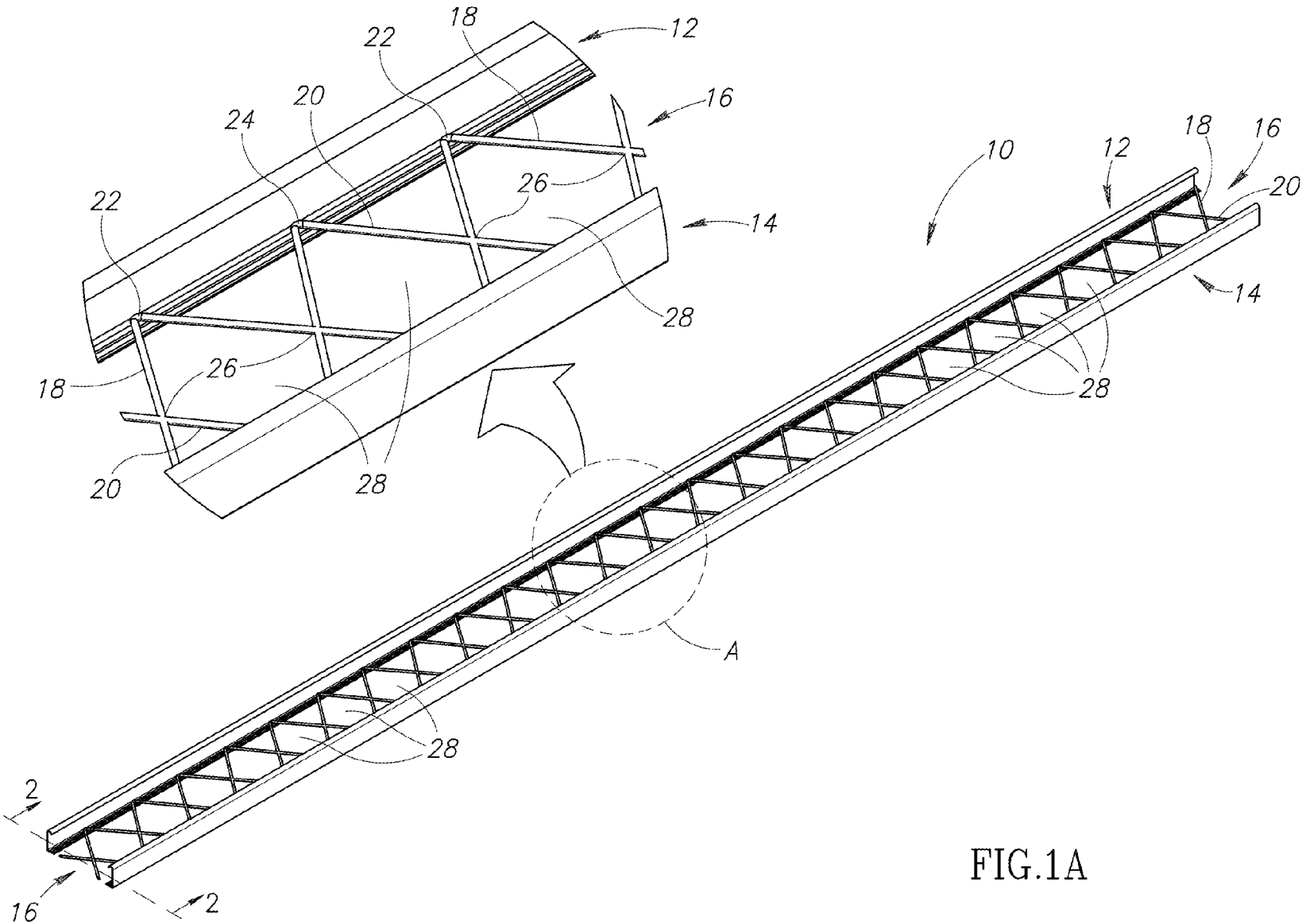
FIG. 1A is an isometric view, with an enlarged partial view, of a metal stud according to one aspect of the disclosure.

FIG. 1A shows a light-weight metal stud 10 according to one aspect of the present disclosure. The stud 10 includes a first elongated channel member 12 and a second elongated channel member 14 positioned at least approximately parallel to and spatially separated from each other. A wire matrix 16 is coupled to and positioned between the first elongated channel member 12 and a second elongated channel member 14 at various portions along the lengths of the members.

Figure 1B:
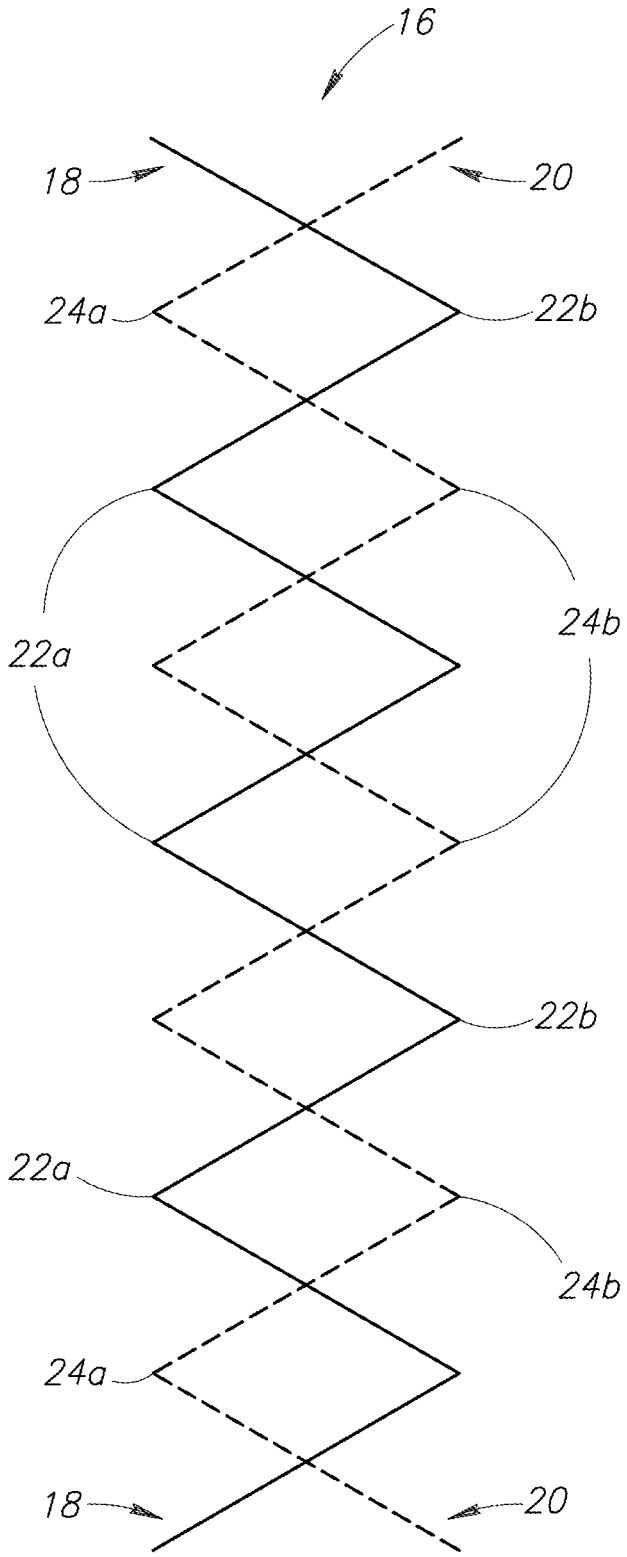
FIG. 1B is schematic view of a wire matrix of the metal stud of FIG. 1A.
Figure 2:
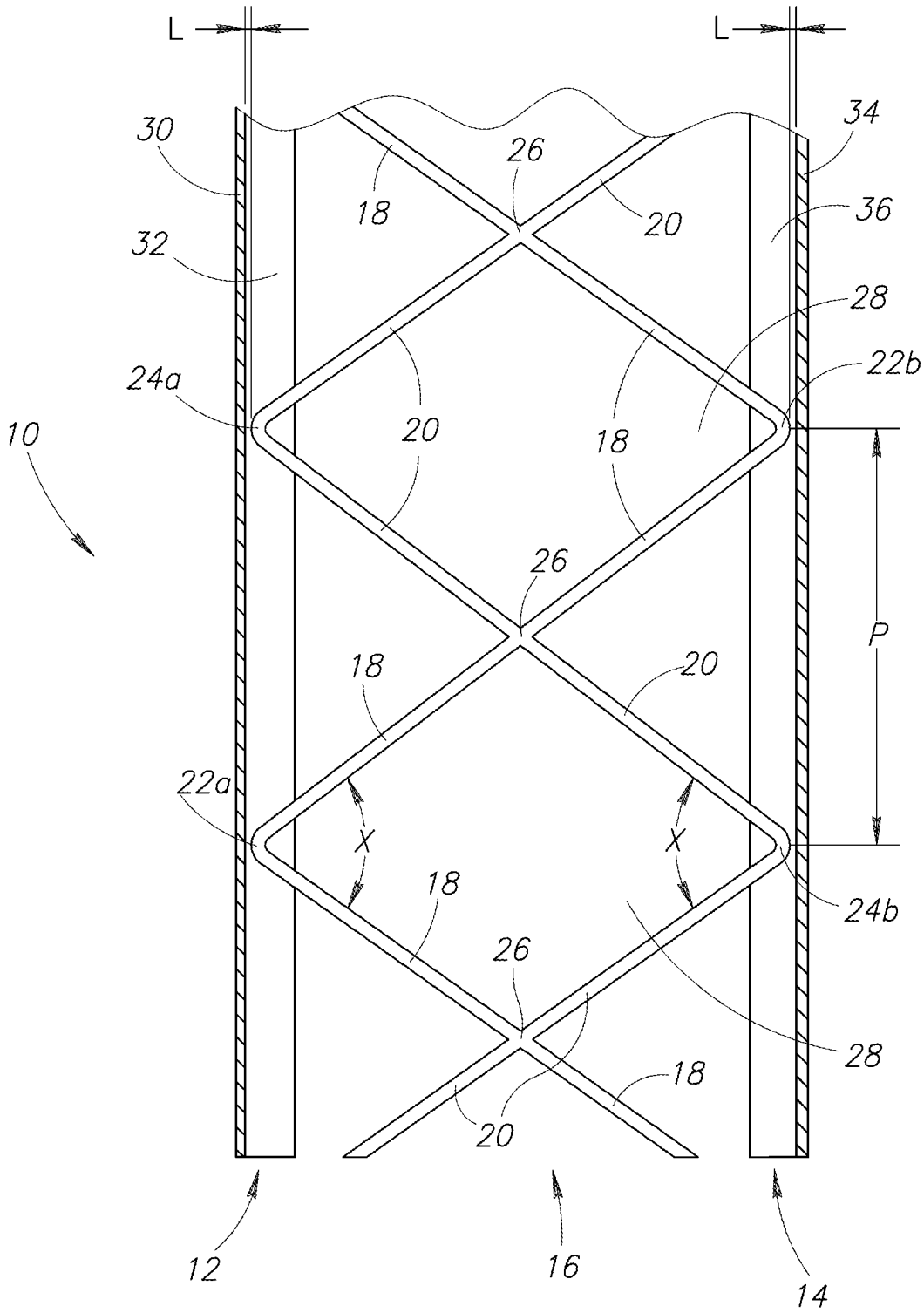
FIG. 2 is a cross-sectional view of a portion of a metal stud according to one aspect of the disclosure.

As illustrated in cutout A, the wire matrix 16 may be comprised of a first angled continuous wire 18 and a second angled continuous wire 20 coupled to each other (FIG. 1B). The first and second angled continuous wires 18, 20 may each be a continuous piece of metal wire. The first angled continuous wire 18 include a plurality of bends that form a plurality of first apexes 22 that successively and alternately contact the first elongated channel member 12 and the second elongated channel member 14. Likewise, the second angled continuous wire 20 may include a plurality of bends that form a plurality of second apexes 24 to successively and alternately contact the first elongated channel member 12 and the second elongated channel member 14 (FIG. 2). The wire matrix 16 may be formed by overlying the first angled continuous wire 18 onto the second angled continuous wire 20 and securing the wires to each other, for example with a series of welds, thereby forming a series of intersection points 26 positioned between the first and second elongated channel members 12, 14. The wire matrix 16 may be secured to the first and second elongated channel members 12, 14 at all first and second apexes 22, 24 such that the first apexes 22 alternate with the second apexes 24 along at least a portion of a length of the first elongated channel member 12 and along at least a portion of a length of the second elongated channel member 14. Accordingly, a series of longitudinal passages 28 are formed along a central length of the wire matrix 16. The longitudinal passages 28 may be quadrilaterals, for instance diamond-shaped longitudinal passages. The longitudinal passages 28 may be sized to receive utilities, for example wiring, wire cables, fiber optic cable, tubing, pipes, other conduit.

The first and second angled continuous wires 18, 20 may each have any of a variety of cross-sectional profiles. Typically, first and second angled continuous wires 18, 20 may each have a round cross-sectional profile. Such may reduce materials and/or manufacturing costs, and may advantageously eliminate sharp edges which might otherwise damage utilities (e.g., electrically insulative sheaths). Alternatively, the first and second angled continuous wires 18, 20 may each have cross-sectional profiles of other shapes, for instance a polygonal (e.g., rectangular, square, hexagonal). Where a polygonal cross-sectional profile is employed, it may be preferred to have rounded edges or corners between at least some of the polygonal segments. Again, this may eliminate sharp edges which might otherwise damage utilities (e.g., electrically insulative sheaths). Further, the second angled continuous wire 20 may a different cross-sectional profile from that of the first angled continuous wire 18.

FIG. 1B shows the particular configuration of a wire matrix 16 of the stud 10 shown in FIG. 1A according to one aspect. The wire matrix 16 includes a first angled continuous wire 18 overlying a second angled continuous wire 20, which is shown in dashed lines for purposes of illustration. This illustration better shows that each of the first and second angled continuous wires 18, 20 extend between both of the first and second elongated channel members 12, 14 in an overlapping manner such that a length of each first and second angled continuous wires 18, 20 extends from one elongated channel member to the other elongated channel member in an alternating manner (FIG. 2). Accordingly, the first angled continuous wire 18 includes a plurality of apexes 22*a* and 22*b* on either side of the first angled continuous wire 18, and the second angled continuous wire 20 includes a plurality of apexes 24*a* and 24*b* on either side of the second angled continuous wire 20 for attachment to both of the first and second elongated channel members 12, 14.

Figure 5:
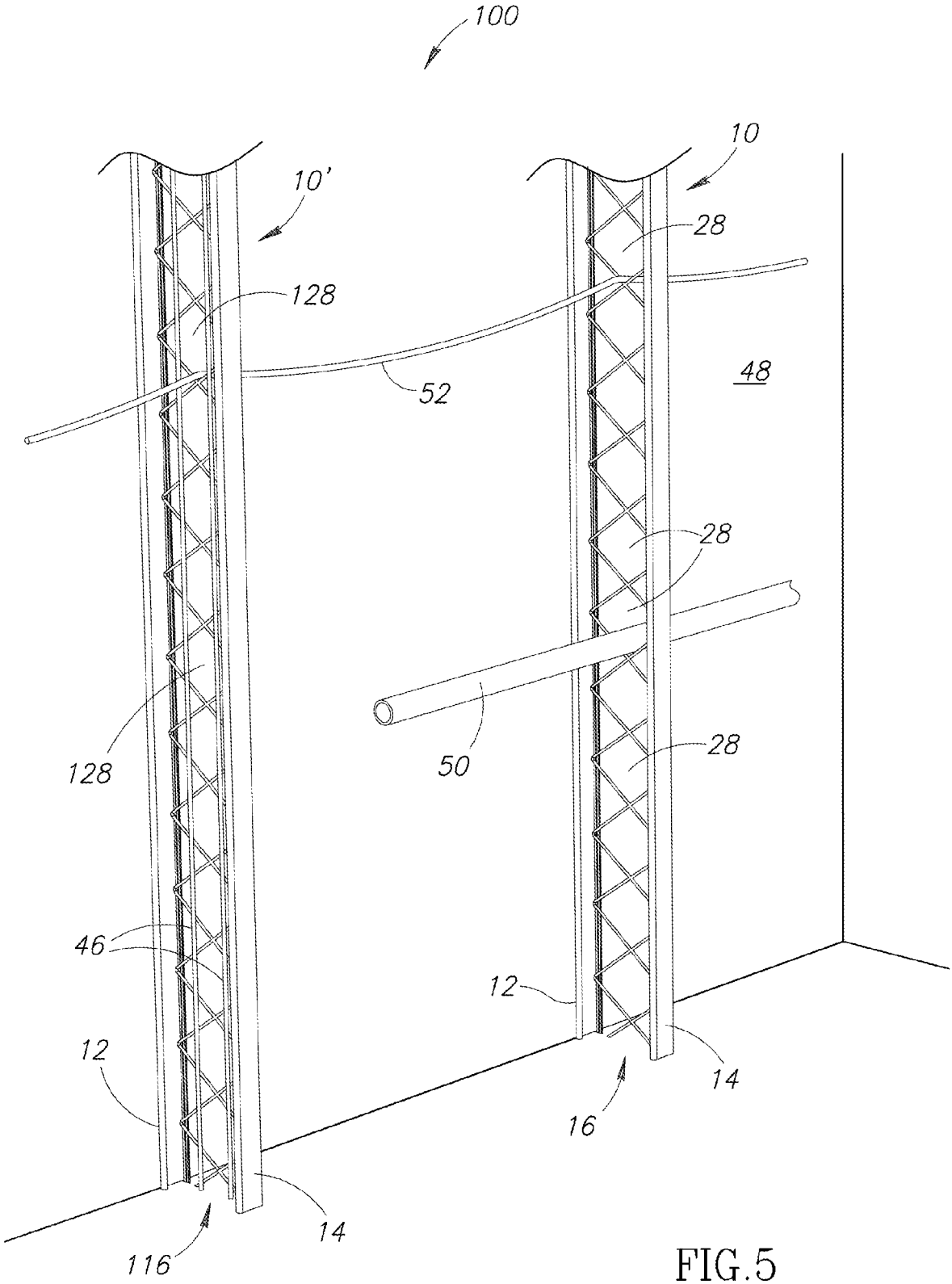
FIG. 5 is an isometric environmental view showing two metal studs adjacent a wall according to some aspects of the disclosure.

FIG. 2 shows a portion of a front cross-sectional view of a stud 10 taken along lines 2-2 of FIG. 1A. The first elongated channel member 12 and the second elongated channel member 14 are shown positioned parallel to and spatially separated from each other with the wire matrix 16 coupling the elongated channel members 12, 14 to each other. The first angled continuous wire 18 is formed with a plurality of bends that form a plurality of first apexes 22*a*, 22*b* that successively and alternately contact the first elongated channel member 12 and the second elongated channel member 14. Likewise, the second angled continuous wire 20 is formed with a plurality of bends that form a plurality of second apexes 24*a*, 24*b* to successively and alternately contact the first elongated channel member 12 and the second elongated channel member 14. The wire matrix 16 may be formed by overlying the first angled continuous wire 18 onto the second angled continuous wire 20 securing the wires to each other with a series of welds, thereby forming a series of intersection points 26 positioned between the first and second elongated channel members 12, 14. The wire matrix 16 may be secured to the first and second elongated channel members 12, 14 at all first and second apexes 22, 24 such that the first apexes 22*a* alternate with the second apexes 24*a* along a length the first elongated channel member 12, and the first apexes 22*b* alternate with the second apexes 24*b* along a length second elongated channel member 14. Accordingly, a series of longitudinal passages 28 are formed along a longitudinal length of the wire matrix 16. The longitudinal passages 28 have a profile that is substantially separate from the first and second elongated channel members 12, 14. As such, the longitudinal passages 28 may act as a shelf to support and receive utility lines or other devices (FIG. 5).

Where the stud 10 is installed vertically, the first and second angled continuous wires 18, 20 will run at angles to the ground and gravitational vector (i.e., force of gravity), that is be neither horizontal nor vertical. Thus, the portions of the first and second angled continuous wires 18, 20 which form each longitudinal passages 28 are sloped with respect to the ground. Utilities installed or passing through a longitudinal passage 28 will tend, under the force of gravity, to settle into a lowest point or valley in the longitudinal passage 28. This causes the utility to be at least approximately centered in the stud 10, referred to herein as self-centering. Self-centering advantageously moves the utility away from the portions of the stud to which wallboard or other materials will be fastened. Thus, self-centering helps protect the utilities from damage, for instance damage which might otherwise be caused by the use of fasteners (e.g., screws) used to fasten wallboard or other materials to the stud 10.

Figure 3:
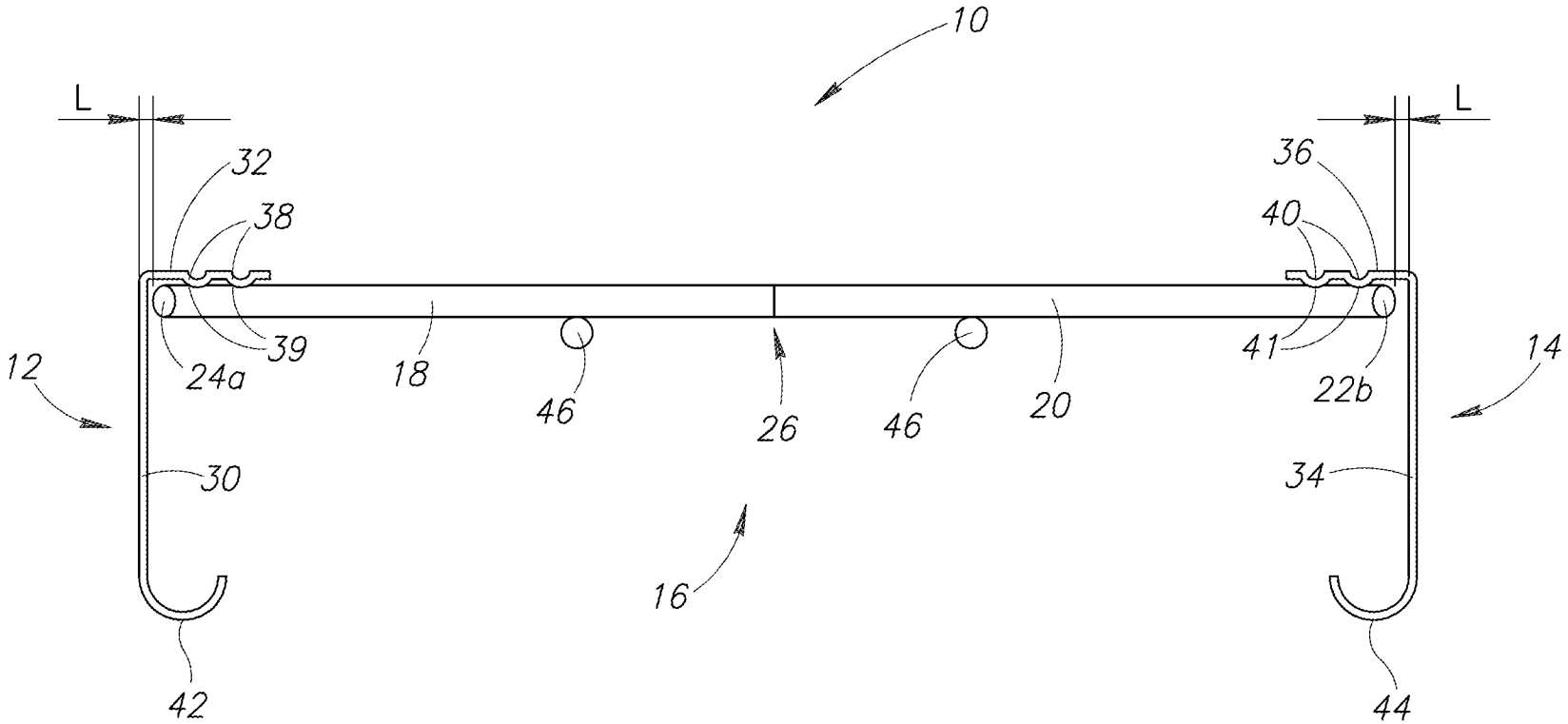
FIG. 3 is a top plan view of a metal stud according to one aspect of the disclosure.

The first elongated channel member 12 may have a major face 30 and a first flange 32. Likewise, the second elongated channel member 14 may have a major face 34 and a first flange 36 (FIG. 3). The wire matrix 16 may be coupled to the flanges 32, 36 periodically along a length of the first and second elongated channel members 12, 14. In some aspects, the first apexes 22*a*, 24*a* may be coupled to the first flange 32 of the first elongated channel member 12 and spatially separated from the major face 30 by a distance L. Likewise, the second apexes 24*b*, 24*b* may be coupled to the first flange 36 of the second elongated channel member 14 and spatially separated from the major face 34 by a distance L. The distance L in any aspect of the present disclosure can vary from a very small to a relatively large distance. In a preferred configuration, distance L is less than one half of an inch, and more preferably less than one quarter of an inch, although distance L can vary beyond such distances. Spatially positioning the apexes from the major faces of the elongated channel members provides one advantage of reducing manufacturing operations and improving consistency of the size and shape of the stud because the elongated channel members can be positioned and secured to the wire matrix relative to each other, as opposed to relative to the shape and size of the wire matrix, which may vary between applications.

According to some aspects, the first apexes 22 and the second apexes 24 laterally correspond to each other as coupled to respective first and second elongated channel members 12, 14. For example, the first apexes 22*a* may be opposed, for instance diametrically opposed, across a longitudinal axis from the second apexes 24*a* along a length the first elongated channel members 12, 14. For example, apex 22*a* is positioned at a contact portion of the first elongated channel member 12 that corresponds laterally to the position of the apex 24*b* on the second elongated channel member 14. The same holds true for apex 24*a* and apex 22*b*, as best illustrated in FIG. 2. The plurality of first and second apexes 22, 24 extend along the length of the stud 10 and are coupled successively and alternately to the first and second elongated channel members 12, 14. Such configuration provides a lightweight metal stud that has improved stiffness characteristics and increased tensile and compression strength, while reducing weight compared to other metal studs. Added stiffening may be provided for fasteners (e.g., screws) for fastening sheathing, drywall or wallboard, and prevents the flange face from rotating away.

Another advantage of the configuration of the stud of the present disclosure is the reduction in distance between apexes along a longitudinal distance of each of the channel members because the wire matrix is formed with two overlapping wires that each fully extend between the elongated channel members. For example, the first angled continuous wire 18 has an apex 22*b* coupled to the second elongated channel member 14, while the second angled continuous wire 20 has an apex 24*b* coupled to the second elongated channel member 14 adjacent apex 22*b* at a pitch P. Pitch P is a given distance that is much shorter than is provided with existing studs. In a preferred configuration, Pitch P is a given distance less than ten inches, and more preferably less than eight inches, although the given distance can vary beyond such distances. Providing a given distance of pitch P provides increased strength of the stud 10 without substantially or noticeably increasing the weight of the stud 10. Another advantage of providing a pitch having a shorter given distance is an increase in stiffness of the stud 10. This is particularly advantageous when applying a force to the major faces 30, 34, such as drilling a fastener through the major faces 30, 34 during and after installation of the stud. The increased stiffness will tend to provide a sufficient biasing force against a drilling force such that the major faces 30, 34 and the stud 10 will not buckle or flex, for example.

Another advantage of the configuration of the stud of the present disclosure is that the first and second angled continuous wires 18, 20 are formed to increase stiffness of the stud 10 and reduce bending moments of the stud 10 under a force. For example, the first and second angled continuous wires 18, 20 may be bent at an angle X, as shown near the apex 22*a* and apex 24*b*. Angle X is preferably between approximately 30 and 60 degrees, and more preferably approximately 45 degrees, although angle X could vary beyond such values and range. Angle X has a corresponding relationship to pitch P. Thus, the continuous wires could be formed at a relatively small angle X (less than 30 degrees), which reduces the distance of pitch P, which can increase strength of the stud for particular applications.

FIG. 3 shows a top view of a light-weight metal stud 10 according to one aspect of the disclosure. The stud 10 includes a first elongated channel member 12 and a second elongated channel member 14 positioned parallel to and spatially separated from each other. A wire matrix 16 is coupled to the first elongated channel member 12 and the second elongated channel member 14 and is positioned substantially perpendicular relative to major faces 30, 34 of the first and second elongated channel members 12, 14. The wire matrix 16 includes a first angled continuous wire 18 and a second angled continuous wire 20 coupled to each other at intersection points 26. As discussed with reference to FIGS. 1A and 2, the first and second angled continuous wires 18, 20 are coupled to the first and second elongated channel members 12, 14 at a plurality of apexes, as exemplified by apex 22*b* and apex 24*a* on FIG. 3.

The first elongated channel member 12 may have a major face 30 and a first flange 32. The first flange 32 may be formed at approximately a 90 degree angle (or non-zero angle) relative to the major face 30. The first flange 32 may include a pair of corrugated portions 38 extending longitudinally along a length of the first flange 32. The ribbed or corrugated portions 38 may have contact portions 39 coupled successively to the wire matrix 16. Likewise, the second elongated channel member 14 may have a major face 34 and a first flange 36. The first flange 36 may be formed at approximately a 90 degree angle (or non-zero angle) relative to the major face 34. The first flange 36 may include a pair of corrugated portions 40 extending longitudinally along a length of the first flange 36. The corrugated portions 40 may have contact portions 41 coupled successively to the apexes 22, 24 of the wire matrix 16. As discussed elsewhere in the disclosure, the first and second angled continuous wires 18, 20 of the wire matrix 16 may be coupled to the flanges 32, 36 periodically along a length of the first and second elongated channel members 12, 14. Such attachment between the wire matrix 16 and the first and second elongated channel members 12, 14 may occur along the corrugated portions 38, 40, which may be achieved by spot welding, resistance welding, or other suitable attachment means at the contact portions 39, 41 of the elongated channel members.

It is preferable that the corrugated portions 38, 40 are each formed as a ridges or valleys, but the corrugated portions 38, 40 may be formed into other shapes. Providing at least one corrugated portion on each flange of each elongated channel member welded to the wire matrix further strengthens the stud by preventing or reducing undesirable flexing or bending due to external forces during and after installation of the stud. Furthermore, the corrugated portions provide high-points of contact between the wire matrix and the elongated channel members, which reduces overall contact area of the components of the stud. This dramatically improves weldability of the wire matrix and the elongated channel members. This also increases weld strengths with much lower energy requirements, less distortion of the stud caused by heat, and reduced burn marks and loss of galvanic zinc coating on the stud. Such advantages also reduce the manufacturing time and operations to form a stud while reducing the weight of the stud.

According to some aspects, the first and second elongated channel members 12, 14 include a respective second flange 42, 44. The second flange 42 extends from the major face 30 of the first elongated channel member 12 inwardly and in an arc-shaped configuration, which may be achieved by rolling the second flange 42 inwardly. Likewise, the second flange 44 extends from the major face 34 of the second elongated channel member 14 inwardly and in an arc-shaped configuration, which may be achieved by rolling the second flange 42 inwardly. Thus, the first and second elongated channel members 12, 14 may each have a J-shaped cross sectional profile. In some aspects, the rolled second flanges 42, 44 can be formed to 45 degrees to almost 360 degrees relative to respective major faces 30, 34. The arc-shaped configuration provides one advantage over existing angled configurations by increasing the strength of the stud 10 while reducing weight because an arc-shaped member tends to counteract bending moments better than angular configuration, particularly when the arc-shaped second flanges 42, 44 are positioned farther away from the bending moments experienced near the first flanges 32, 36 of the wire matrix 16. Furthermore, forming an arc-shaped support member includes fewer operations than forming a multi-angled flange, as with existing studs, which reduces the complexity and manufacturing processes of the stud 10.

According to some aspects, the wire matrix 16 may be coupled to the first flange 32 of the first elongated channel member 12 and spatially separated from the major face 30 by a distance L such that the all apexes are not in contact with the major face 30. Likewise, the wire matrix 16 may be coupled to the first flange 36 of the second elongated channel member 14 and spatially separated from the major face 34 by a distance L, as further discussed with reference to FIG. 2.

According to some aspects, a pair of longitudinal wires 46 may be coupled to the first and second wire members 18, 20. The wire members 18, 20 may extend along the major length of the first channel member and may be spaced inwardly from the first channel member 12 toward the second channel member 14 (FIG. 5). The longitudinal wires 46 may be secured for additional structural support and for positioning utility lines that may traverse through the various longitudinal passages defined by the wire matrix 16 and the pair of longitudinal wires 46.

Figure 4:
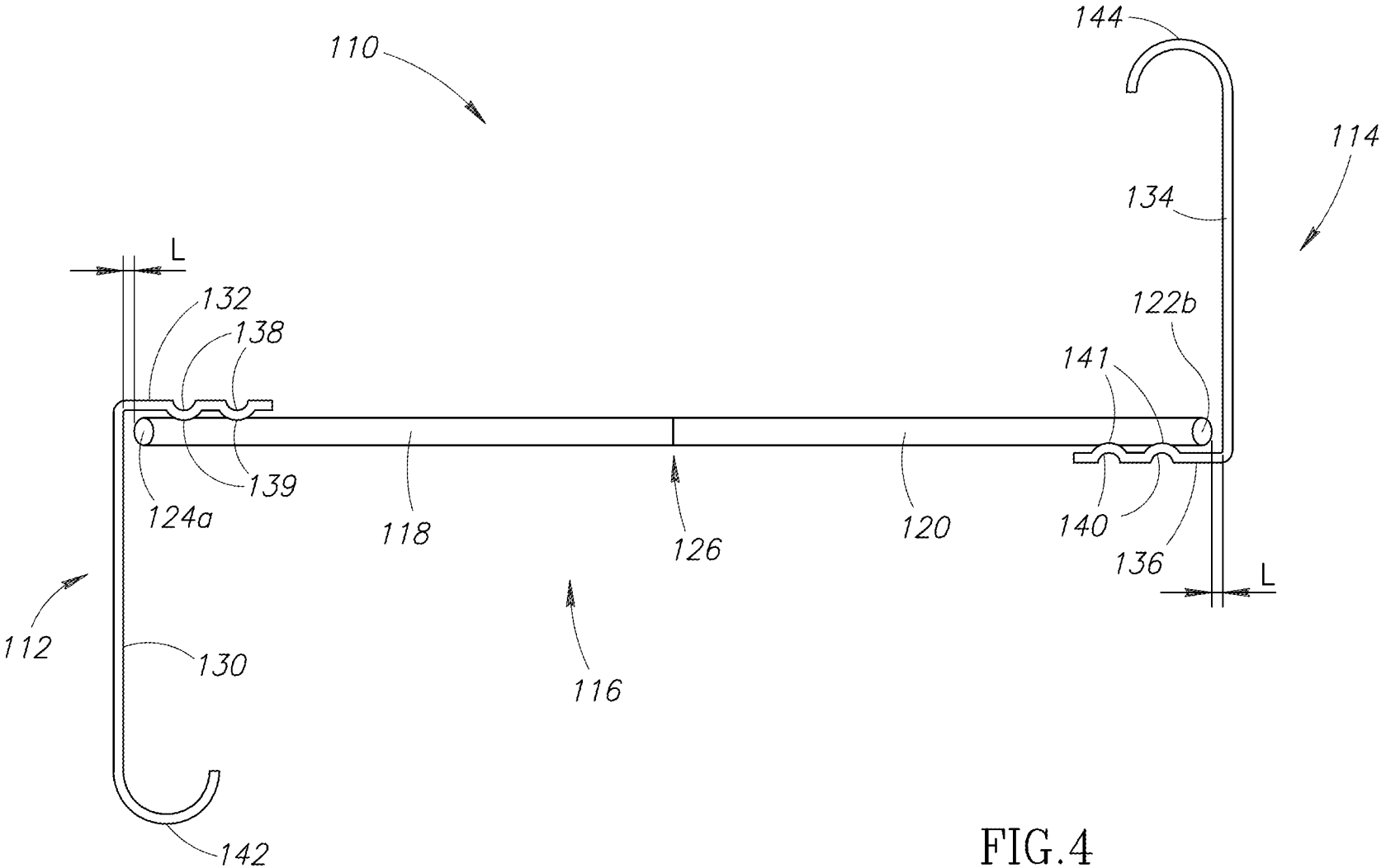
FIG. 4 is a top plan view of a metal stud according to one aspect of the disclosure.

FIG. 4 shows a top view of a light-weight metal stud 110 according to one aspect of the disclosure. The stud 110 includes a first elongated channel member 112 and a second elongated channel member 114 positioned parallel to and spatially separated from each other. In this regard, the second elongated channel member 114 is "flipped" or inverted relative to the first elongated channel member 112, as compared to the description regarding FIGS. 1A-3. Accordingly, a wire matrix 116 is coupled to the first elongated channel member 112 and a second elongated channel member 114 and is positioned approximately perpendicular relative to the first and second elongated channel members 112, 114. The inverted configuration of the stud 110 having the first and second elongated channel members 112, 114 is commonly known as a Z-girt stud, which is typically used in exterior walls of a structure for securing insulation batts (e.g., acoustical insulation) between adjacent studs, while minimizing a transfer of sound.

The wire matrix 116 may include a first angled continuous wire 118 and a second angled continuous wire 120 coupled to each other at intersection points 126, such as discussed with reference to FIGS. 1A-3. The first and second angled continuous wires 118, 120 include a plurality of apexes 122, 124 that are coupled to the first and second elongated channel members 112, 114, as exemplified by apex 122*b* and apex 124*a*, for example.

The first elongated channel member 112 may have a major face 130 and a first flange 132. The first flange 132 may be formed inwardly toward the wire matrix 116 at approximately a 90 degree angle (or non-zero angle) relative to the major face 130. The first flange 132 may include a pair of corrugated portions 138 extending longitudinally along a length of the first flange 132 for attachment to the wire matrix 116. Likewise, the second elongated channel member 114 may have a major face 134 and a first flange 136. The first flange 136 may be formed inwardly toward the wire matrix 116 at approximately a 90 degree angle (or non-zero angle) relative to the major face 134. The flange 136 may include a pair of corrugated portions 140 extending longitudinally along a length of the flange 136 for attachment to the wire matrix 116 on an opposing face of the wire matrix 116 relative to the corrugated portions 138 of the flange 132. As discussed elsewhere in the present disclosure, the plurality of apexes 122, 124 of the wire matrix 116 may be coupled to contact portions 139, 141 of the respective first flange 132, 136 alternatively along a length of the first and second elongated channel members 112, 114. Such attachment between the wire matrix 116 and the first and second elongated channel members 112, 114 may occur alternatively along the corrugated portions 138, 140, whether by spot welding, resistance welding, or other suitable attachment means.

According to some aspects, the apexes of the wire matrix 116 may be coupled to the first flange 132 of the first elongated channel member 112 and spatially separated from the major face 130 by a distance L. Likewise, the apexes of the wire matrix 116 may be coupled to the first flange 136 of the second elongated channel member 114 and spatially separated from the major face 134 by a distance L. This configuration may provide the same or similar advantages, as further discussed with reference to FIGS. 1A-3.

According to some aspects, the first and second elongated channel members 112, 114 may each include a second flange 142, 144. The second flange 142 of the first elongated channel member 112 may extend from the major face 130 inwardly and in an arc-shaped configuration, which may be achieved by rolling the flange inwardly. Likewise, the second flange 144 of the second elongated channel member 114 may extend from the major face 134 inwardly and in an arc-shaped configuration. Thus, the first and second elongated channel members 112, 114 each may have a J-shaped cross sectional profile. In some aspects, the arc-shaped second flanges 142, 144 can be formed from 45 degrees to almost 360 degrees relative to respective major faces 130, 134. The arc-shaped configuration provides the same or similar advantages discussed with reference to FIG. 3.

The Z-girt stud shown in FIG. 4 provides numerous advantages. Conventional Z-girt metal studs are typically formed of one continuous sheet of metal that is bent into a Z-shaped stud. Attached to sheet metal surfaces formed by the Z-shaped stud may be utility lines, fasteners, gang boxes, and other lines and devices. Thus, moisture from rain and snow that may leak into external walls can readily be trapped by the major faces of conventional Z-girt studs and the devices attached thereto, which can lead to heat losses, formation of mold, and corrosion, which poses safety and efficiency concerns. Conversely, the present disclosure provides a metal stud that permits moisture to more easily pass through portions of the stud and not be trapped by surfaces or components. This is achieved due to the plurality of longitudinal passages defined by the wire matrix, which allow increased air flow and allow moisture to drain substantially downwardly as opposed to being trapped on a planar surface, for example. Additionally, the contact portions between the wire matrix and the elongated channel members are raised such that moisture is allowed to pass through and quickly dry due to the reduced surface-to-surface contact between the wire matrix and the elongated channel members, as compared to available designs.

FIG. 5 shows a stud system 100 having a pair of light-weight metal studs according to one aspect of the present disclosure. The system 100 includes a first stud 10 and a second stud 10' positioned spatially apart from each other and against a wall 48, as with typical structural arrangements. The first stud 10 and the second stud 10' each include a first elongated channel member 12 and a second elongated channel member 14 positioned parallel to and spatially separated from each other. The first stud 10 includes a wire matrix 16 coupled to and positioned between the first elongated channel member 12 and the second elongated channel member 14 at various portions along the lengths of the members, such as described with reference to FIGS. 1A-3. The second stud 10' includes a wire matrix 116 coupled to and positioned between the first elongated channel member 12 and the second elongated channel member 14 at various portions along the length of the elongated channel members, such as described with reference to FIGS. 1A-3. The wire matrix 116 may include a pair of longitudinal wires 46 coupled to the wire matrix 116. The pair of longitudinal wires 46 may be parallel to each other and coupled to the wire matrix 116 along various intersection points. The pair of longitudinal wires 46 may be positioned spatially parallel to and between the first and second elongated channel members 12, 14. The longitudinal wires 46 may be secured for additional structural support. Importantly, the pair of longitudinal wires 46 defines a plurality of longitudinal passages 128 for positioning utility lines through the longitudinal passages 128. In this aspect, smaller utility lines, such as an electrical wire 52, can be positioned through the longitudinal passage 128 (or numerous longitudinal passages) to physically separate utility lines from each other and away from sharp edges of the first and second elongated channel members 12, 14 of the stud 10'.

Likewise, the wire matrix 16 of the stud 10 defines a plurality of longitudinal passages 28 along a central length of the wire matrix 16. The longitudinal passages 28 may partially or completely structurally support utility lines, such as the electrical wire 52 and a pipe 50. Additionally, the longitudinal passages 28 allow egress of utility lines to physically separate the utility lines from each other and away from sharp edges of the first and second elongated channel members 12, 14 to reduce or prevent damage to the lines and to increase safety.

While the metal stud is disclosed as employing two distinct continuous (e.g., single piece constructions) wire members, other implementations may employ wire members composed of distinct portions (e.g., a plurality of V-shaped or L-shaped portions) physically coupled to one another, for example via welding, to form an integral structure. As such implementations may be more difficult and expensive to manufacture and/or may have different strength and/or rigidity, these implementations may be less preferred than a single piece construction or continuous wire member.

The various embodiments may provide a stud with enhance thermal efficiency over more conventional studs. While metals are typically classed as good thermal conductors, the studs described herein employ various structures and techniques to reduce conductive thermal transfer thereacross. For instance, the wire matrix, welds (e.g., resistance welds), and the weld points (e.g., at peaks) may contribute to the energy efficiency of the stud.

The various embodiments described above can be combined to provide further embodiments. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A stud, comprising:

a first elongated channel member, the first elongated channel member having a respective major face having a respective first edge along a major length thereof and a respective second edge along the major length thereof, a respective first flange extending along the first edge at a non-zero angle to the respective major face of the first elongated channel member, and a respective second flange extending along the second edge at a non-zero angle to the respective major face of the first elongated channel member;

a second elongated channel member, the second elongated channel member having a respective major face having a respective first edge along a major length thereof and a respective second edge along the major length thereof, a respective first flange extending along the first edge at a non-zero angle to the respective major face of the second elongated channel member, and a respective second flange extending along the second edge at a non-zero angle to the respective major face of the second elongated channel member;

a first continuous wire member having a plurality of bends to form alternating apexes along a respective length thereof, the apexes of the first continuous wire member alternatingly physically attached to the first and the second elongated channel members along at least a portion of the first and the second elongated channel members; and a second continuous wire member having a plurality of bends to form alternating apexes along a respective length thereof, the apexes of the second continuous wire member alternatingly physically attached to the first and the second elongated channel members along at least a portion of the first and the second elongated channel members, the first and the second elongated channel members held in spaced apart parallel relation to one another by both of the first and the second wire members, with a longitudinal passage formed therebetween; and wherein the first and the second wire members are physically attached to one another at each point at which the first and the second wire members cross one another.

2. The stud of claim 1 wherein each of the apexes of the second wire member is opposed to a respective one of the apexes of the first wire member across the longitudinal passage.

3. The stud of claim 1 wherein the respective second flange of at least one of the first or the second elongated channel member is a non-right angle.

4. The stud of claim 1 wherein the respective second flange of at least one of the first or the second elongated channel member is a rolled edge.

5. The stud of claim 1 wherein the respective second flange of each of the first and the second elongated channel member is has an arcuate profile.

6. The stud of claim 1 wherein the first flange of at least one of the first or the second elongated channel member is corrugated, having a plurality of ridges or valleys extending along the major length of the first edge.

7. The stud of claim 6 wherein the first and the second continuous wires are physically attached to the ridges or the valleys of the respective first flange of at least one of the first and the second elongated channel member via welds and do not physically contact the respective major faces of at least one of the first or the second elongated channel member.

8. The stud of claim 1 wherein the first and the second continuous wires are physically attached to the respective first flange of both the first and the second elongated channel member via welds and do not physically contact the respective major faces of the first and the second elongated channel member.

9. The stud of claim 1, further comprising:

a first longitudinal wire member extending along the major length of the first channel member, spaced inwardly from the first channel member toward the second channel member; and a second longitudinal wire member extending along the major length of the second channel member, spaced inwardly from the second channel member toward the first channel member, and spaced apart from the first longitudinal wire member.

10. A stud, comprising:

a first elongated channel member, the first elongated channel member made of a metal and having a respective major face having a respective first edge along a major length thereof and a respective second edge along the major length thereof, a respective first flange extending along the first edge at a non-zero angle to the respective major lace of the first elongated channel member, and a respective second flange extending along the second edge at a non-right angle to the respective major face of the first elongated channel member;

a second elongated channel member, the second elongated channel member made of a metal and having a respective major face having a respective first edge along a major length thereof and a respective second edge along the major length thereof, a respective first flange extending along the first edge at a non-zero angle to the respective major face of the second elongated channel member, and a respective second flange extending along the second edge at a non-right angle to the respective major face of the second elongated channel member;

a first metal coupler member having a plurality of bends to form alternating apexes along a respective length thereof, the apexes of the first metal coupler physically attached alternatingly to the first and the second elongated channel members along at least a portion of the first and the second elongated channel members; and a second metal coupler having a plurality of bends to form alternating apexes along a respective length thereof, the apexes of the second metal coupler physically attached alternatingly to the first and the second elongated channel members along at least a portion of the first and the second elongated channel members, the first and the second elongated channel members held in spaced apart parallel relation to one another by the first and the second metal couplers with a longitudinal passage formed therebetween; and wherein the first and the second metal couplers are physically attached to one another at each point at which the first and the second metal couplers cross one another.

11. The stud of claim 10 wherein the first and the second metal couplers are each continuous wire members.

12. The stud of claim 10 wherein the first flange of at least one of the first or the second elongated channel member is corrugated, having a plurality of ridges or valleys extending along the major length of the first edge.

13. The stud of claim 12 wherein the first and the second metal couplers are physically attached to the ridges of the respective first flange of the first and the second elongated channel member via welds and do not physically contact the respective major faces of at least one of the first or the second elongated channel member.

14. The stud of claim 10, further comprising:

a first longitudinal wire member extending along the major length of the first channel member, spaced inwardly from the first channel member toward the second channel member; and a second longitudinal wire member extending along the major length of the second channel member, spaced inwardly from the second channel member toward the first channel member, and spaced apart from the first longitudinal wire member.

15. A method of making a metal stud, the method comprising:

providing a first elongated channel member having a respective major face having a respective first edge along a major length thereof and a respective second edge along the major length thereof, a respective first flange extending along the first edge at a non-zero angle to the respective major face of the first elongated channel member, and a respective second flange extending along the second edge at a non-zero angle to the respective major face of the first elongated channel member;

providing a second elongated channel member having a respective major face having a respective first edge along a major length thereof and a respective second edge along the major length thereof, a respective first flange extending along the first edge at a non-zero angle to the respective major face of the second elongated channel member, and a respective second flange extending along the second edge at a non-zero angle to the respective major face of the second elongated channel member; and coupling the first and the second elongated channel member together with a first and a second continuous wire member each having a plurality of bends to form alternating apexes along a respective length thereof, the apexes of the first continuous wire member alternatingly physically attached to the first and the second elongated channel members along at least a portion of the first and the second elongated channel members, and the apexes of the second continuous wire member alternatingly physically attached to the first and the second elongated channel members along at least a portion of the first and the second elongated channel members; and, physically attaching the first and the second continuous wire members to one another at intersection points thereof.

16. The method of claim 15 wherein the physically attaching the first and the second continuous wire members to one another at intersection points thereof occurs before the coupling the first and the second elongated channel member together via the first and the second continuous wire members.

17. The method of claim 15, further comprising:

rolling the respective second edge of the first and the second channel members to form the non-right angle flange.

* * * * *